United States Patent [19]

Ostgaard

[11] 4,257,720

[45] Mar. 24, 1981

[54] APPARATUS AND METHOD FOR DRIVING MEMBERS INTO THE OCEAN FLOOR

[75] Inventor: John T. Ostgaard, Los Angeles, Calif.

[73] Assignee: Pipe Technology Systems, Inc., El Segundo, Calif.

[21] Appl. No.: 3,593

[22] Filed: Jan. 15, 1979

[51] Int. Cl.[3] ..... E02D 5/28

[52] U.S. Cl. ..... 405/227; 405/224; 405/228; 405/184; 254/29 R

[58] Field of Search ..... 405/184, 232, 224, 195–209; 254/29 R

[56] References Cited

U.S. PATENT DOCUMENTS

| | | | |
|---|---|---|---|
| 1,948,707 | 2/1934 | Gilman | 405/184 |
| 2,209,660 | 7/1940 | Oka | 254/29 R |
| 2,771,747 | 11/1956 | Rechtin | 405/208 |
| 2,807,937 | 10/1957 | Rhodes | 405/170 |
| 2,995,900 | 8/1961 | Hunsucker | 405/224 X |
| 3,005,314 | 10/1961 | Cunningham | 254/29 R |
| 3,233,315 | 2/1966 | Leyake | 405/154 |
| 3,381,478 | 5/1968 | Wells | 254/29 R X |
| 3,861,156 | 1/1975 | Uchida | 405/232 |
| 3,895,471 | 7/1975 | Kolb | 405/227 |
| 3,930,374 | 1/1976 | Hoppe | 405/224 |
| 3,998,428 | 12/1976 | Miles | 254/29 R |
| 4,070,867 | 1/1978 | Cassidy | 405/232 X |
| 4,082,248 | 4/1978 | Hinrichsen | 254/29 R |
| 4,151,888 | 5/1979 | Jansz | 405/232 |
| 4,159,819 | 7/1979 | Bargel | 254/29 R |

*Primary Examiner*—Dennis L. Taylor

*Attorney, Agent, or Firm*—Fulwider, Patton, Rieber, Lee & Utect

[57] ABSTRACT

Members, such as piles for off-shore oil and gas well platforms, are driven into the ground by the extension of a hydraulic jacking cylinder. The cylinder is held in position within a working tower in which the uppermost pile section is contained. Electro-osmosis may be used to reduce soil friction. Successive pile sections are brought into position by securing them to a horizontal loading door of the working tower and then raising the door pivotally. The section is then suspended within the working tower and aligned with the prececing section by an internal alignment tool prior to welding.

29 Claims, 17 Drawing Figures

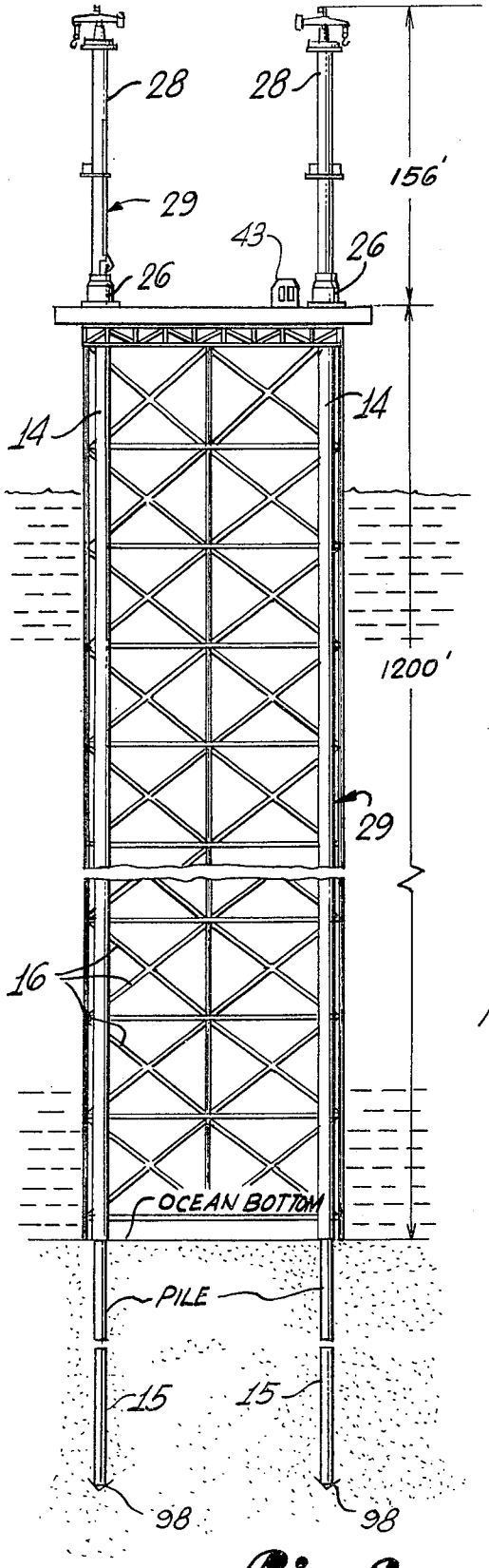
Fig. 2
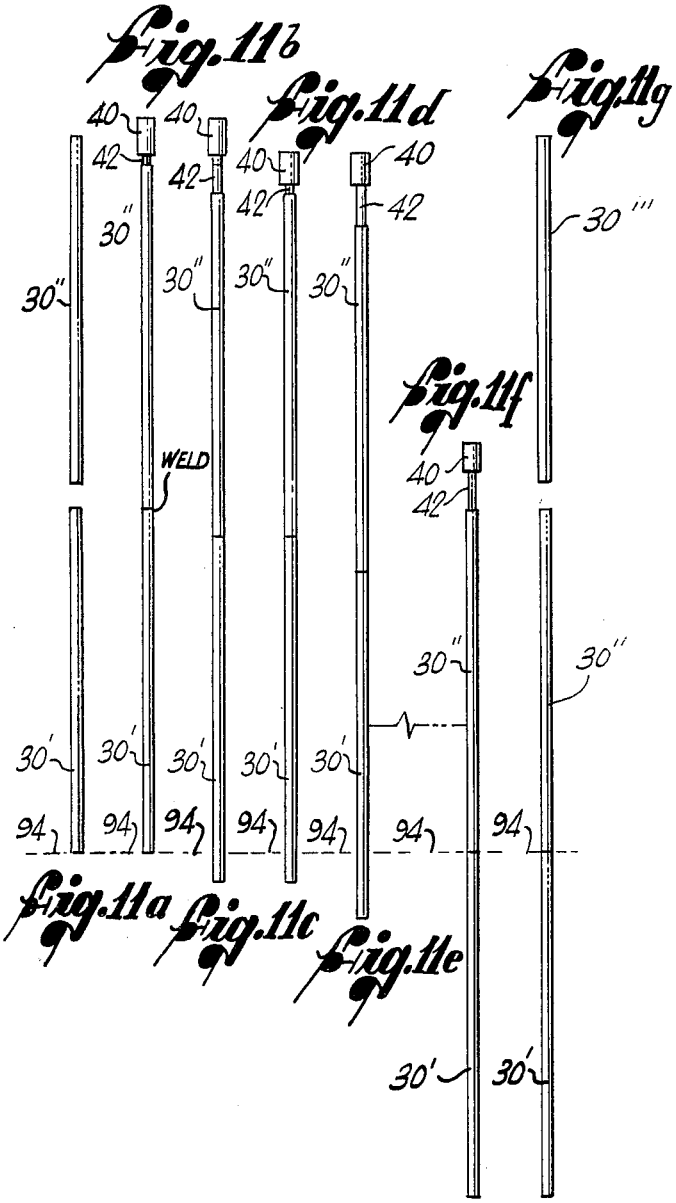

APPARATUS AND METHOD FOR DRIVING MEMBERS INTO THE OCEAN FLOOR

BACKGROUND OF THE INVENTION

The present invention relates to methods and apparatus for driving members into the ocean floor. It has particular relevance to driving piles, as in the construction of off-shore platforms for oil and gas wells, and also relates to driving casings and conductors for such wells.

It is often desired to drive a member into the ocean floor to depths of several hundred feet or more. Common examples of such members are pilings that support a platform from which oil and gas wells are drilled and operated. Other examples are casings within which an off-shore well is drilled and conductors that contain conduits through which oil and gas flow upwardly to the surface.

The present state of the art calls for pounding the member into the ocean floor by the repeated blows of a hammer. Each blow may contain more than one million foot pounds of energy, but at deep penetrations drives the member only a fraction of a foot.

Piles for off-shore platforms serve as a good example of the state of the art of driving such members, although certain unique problems are involved. The piles for these platforms are usually driven about 200 to 500 feet into ocean floor, depending on the type of soil, the water depth and the expected loads due to storms and other forces. Some of the more recently proposed deep water platforms are of the guyed tower type in which guys anchored to the ocean floor take horizontal loads and the piles of the structure take vertical loads and the horizontal loads at the mud line. Some such proposals call for flexible piles that permit significant horizontal movement at the top.

The pile is driven in sections, typically 80 feet or more in length. A hammer and its leads, which may weigh 600 tons or more, must be supported above the pile by a crane mounted on a barge. The further into the ocean floor the pile is driven, the greater the force required to drive it and the larger the hammer must be. Some experts believe that a large portion of the hammer energy is absorbed by radial movement and vibration of the pile throughout its length.

Each successive pile section is welded to the one that precedes it. The new section must be held by a barge-mounted crane and suspended above the preceding section to which it is to be attached. A stabbing guide must be attached to the bottom of the new section to facilitate its insertion.

As the new section is positioned, the beveled ends of the sections that facilitate welding are easily damaged. The difficult and time-consuming welding operation, that requires precise positioning of the sections, is hindered by the tendency of the new section to move relative to the preceding section as the barge moves with wind and water currents. The direct effects of wind and water spray on the welding equipment can make welding impossible for long periods of time, even if the positioning problems can be overcome.

Many areas in which platforms are located, including, for example, the North Sea, frequently have severe storms. It is, therefore, necessary to wait for a suitable "weather window" during which to erect the platform and drive the piles. As the water depth and the time required to drive the piles increases, the necessary window becomes larger. The difficulty of finding such a window increases as does the chance of an unexpected storm that could prove disastrous. It is important to drive the piles as rapidly as possible so that the structure can withstand heavy seas, if necessary.

All the above limitations, the hammer size requirements, the necessary weather window and the maximum available size of cranes, barges and other support equipment, collectively known as the spread, place a practical upper limit on the water depth in which off-shore platforms can be located. At present, there are only a few platforms in as much as 1,000 feet of water. The demand for oil from many deep water locations in which it is known to exist cannot be met without new concepts and basic improvements in the method and apparatus by which piles are driven.

The tallest platform structures contemplated today are of the guyed tower type in which the piles are intended to bend rather than resist horizontal loads. In structures of this type, the problems arising from the use of a hammer are compounded since piles having the desired flexibility will absorb a large portion of the hammer energy and it may be impossible to drive the piles to the desired penetration.

Apart from the size limitations of the technology in use today, there are other disadvantages associated with conventional hammer-driven piles that relate to their essential purpose of securing the platform. When the pile is hammered, it unavoidably moves radially as it abruptly surges downwardly with each blow. In so doing, it disturbs the soil around it, and may leave an annular space between the pile and the soil which reduces soil friction. Although the soil may regain part of this initial strength as it settles, some loss is permanent. The result is that the forces and energy required to remove the pile are less than that required to drive it and the holding power of the pile is not accurately predictable, even if the energy used in driving it is known.

A problem experienced with hammer-driven piles is that the numerous variables make it difficult or impossible to accurately monitor the force required to drive the pile at successive penetration levels. For this reason, existing techniques that attempt to predict the static-bearing capacity of a pile based on the history of its dynamic driving resistance are not totally reliable. To compensate for this unrealiability, large safety factors must be included in design specifications. In some situations, a pile is driven at considerable cost to a predetermined depth far greater than that required to secure the platform when soil conditions offer more resistance than expected.

Objectives of the present invention are to provide new methods and apparatus for driving piles and other members more efficiently. A further objective is to utilize apparatus that is of less weight, has lower energy requirements, and is more easily managed, permitting construction at greater water depths. Other objectives are to drive the member in a manner that minimizes the disturbance of the soil surrounding it and renders the holding power of the member more predictable.

SUMMARY OF THE INVENTION

According to the present invention, members, such as piles for off-shore oil and gas well platforms, are driven into the ocean floor by the expansion of hydraulic jacking cylinders. Any radial movement or vibration of the members is substantially eliminated so that the disturbance of the soil is minimized and the maximum adhesive strength of the soil is retained. Since the maximum instantaneous load on the member is reduced, the wall thickness can be reduced correspondingly. The force applied to the members can be accurately monitored so that the staticbearing capacity of the members can be estimated. Adhesion forces can be reduced substantially by the use of electroosmosis, if desired.

A more detailed aspect of the invention relates to a tower located where the member is to be driven. The member is positioned contiguously with the tower and the jacking cylinder is connected to the tower to prevent upward movement of the cylinder as it is extended to jack the member downwardly. The cylinder is then contracted and lowered before it is extended again to drive the member in a step-wise manner.

The upper portion of the tower forms a working tower into which successive sections of the member are loaded by securing them to a horizontal loading door and then pivotally raising the door. This loading technique eliminates the need to lift the sections by crane to their full vertical height and greatly reduces the likelihood of damaging the ends of the sections.

Once a new section is within the working tower, an alignment tool suspended beneath the jacking cylinder can be lowered into it. The tool expands to engage and support the new section and then expands again to engage the preceding section thereby aligning the sections and holding them in a proper spaced relationship for welding. For this purpose, the alignment tool is provided with two axially spaced sets of shims that can be expanded radially in sequence. In addition to their holding and alignment functions, the shims ensure that the ends of the sections are not out of round while being welded. The alignment tool can also be used to raise and lower the new pile section while it is gripped by the shims.

A preferred apparatus for driving piles for an offshore platform includes a horizontal deck, above the water level, with four legs that extend downwardly to the ocean floor. Each leg can serve as a jacket for one of the contiguous piles. The working towers extend upwardly from the deck so that each working tower is aligned with one leg to form a composite tower that reaches from the ocean floor to a height well above the water level. Two piles are driven simultaneously at two diagonally opposite corners of the deck so that the stability of the structure is maintained at all times.

Other features and advantages of the present invention will become apparent from the following detailed description, taken in conjunction with the accompanying drawings, which illustrate, by way of example, the principals of the invention.

BRIEF DESCRIPTION OF THE DRAWINGS

FIG. 2 is a side view of the structure of FIG. 1 during installation, a portion of the structure being broken away to reduce its height;

FIGS. 11*a*–11*g* are schematic representations of piles and jacking cylinders during various phases of the construction of the structure.

DESCRIPTION OF THE PREFERRED EMBODIMENT

Figure 1:
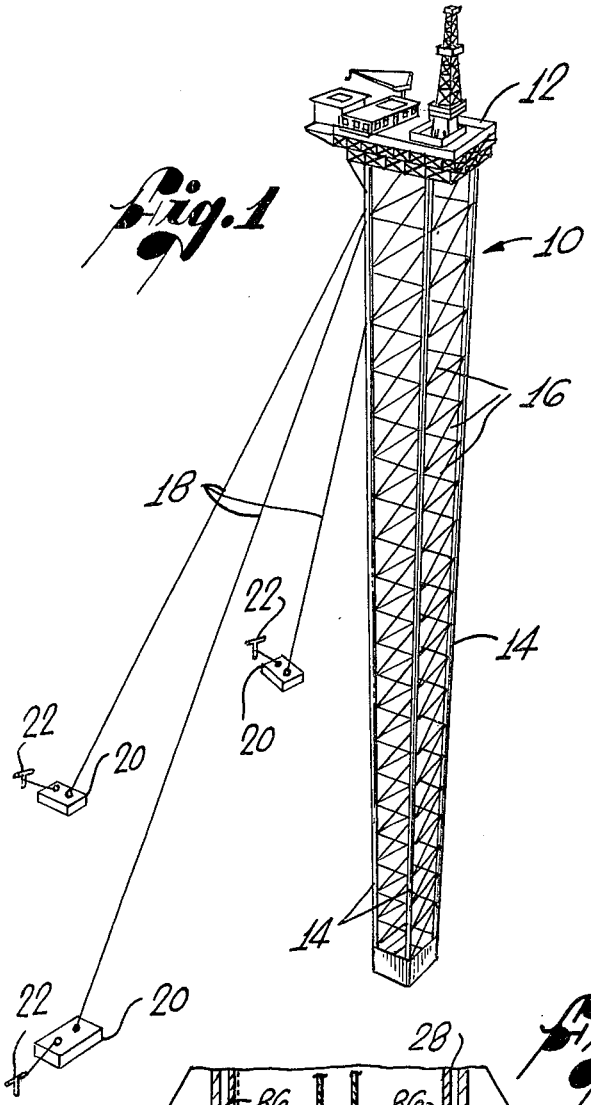
FIG. 1 is a perspective view of a completed gas and oil well platform structure of the guyed tower type, suitable for installation in accordance with the present invention.

The present invention will be explained in greater detail with respect to the construction of an off-shore oil or gas well platform structure 10, shown in FIG. 1. It will be understood, however, that the invention has wide application and the reference to this particular structure 10 is merely exemplary.

The platform structure 10 is of the guyed tower type which is well suited for use in deep water, i.e., 600 feet or more. This basic structure 10 is known to those skilled in the art. It includes a drilling and production platform 12 that extends horizontally above the water surface and is supported by four legs 14 that project vertically from the platform to the ocean floor. The legs 14 are equally spaced at the corners of a square and connected by crossed braces 16 across the sides of the square. Within each leg 14 is a pile 15 (not shown in FIG. 1) that reaches downwardly from the platform 12 and penetrates several hundred feet into the ocean floor. It will be understood that the term "vertical" as applied to the legs 14 and piles 15 encompasses any relatively small angularity of the legs incorporated in the particular structure 10.

The legs 14 and the piles 16 are primarily intended to absorb vertical loads and are sufficiently flexible to allow the platform 12 to shift horizontally at the water line. This horizontal movement is restrained and limited by a plurality of guys 18 (only three of which are shown in FIG. 1) that extend at angles of about 45 degrees to an array of outlying locations on the ocean floor where they are secured to weights 20 and then, further away from the platform structure 10, to anchors 22.

When the platform structure 10 is in a neutral position, all the weights 20 rest on the ocean floor and horizontal movement of the platform 12 at the water line in any direction is resisted by the inertia of the weights as well as the spring rate of the legs 14 and piles 15. If, however, a large enough horizontal force is applied to the structure 10 by winds and water currents, the weights 20 on one side will be lifted as the piles 15 flex to permit the platform 12 to move while the entire structure bends. This movement is ultimately limited by the anchors 22 when the guys 18 on one side are pulled tight.

While the structure 10 is being erected, the drilling and production platform 12 of FIG. 1 is not in place. Only a structural framework, referred to herein as a deck 24 and shown in FIG. 2, serves as a platform during this phase of the operation. On top of each leg 14, at the level of the deck 24, is a cabin-like welding habitat 26 (best shown in FIG. 3) of larger diameter than the leg. A vertical working tower 28 extends upwardly from the center of each welding habitat 26. In essence, the structure 10 includes four composite towers 29 that extend from the ocean floor and reach more than 100 feet above the water surface, each of these composite towers being formed by a leg 14, a welding habitat 26, and a working tower 28. All four towers 29 are joined just above the water level by the deck 24.

Each tubular section 30 of the pile 15 is typically about eighty feet long and six feet or more in diameter. It is made of steel and has a wall thickness of about one to two and one-half inches. The piles 15 thus have the required flexibility to permit horizontal movement at their top ends.

Figure 4:
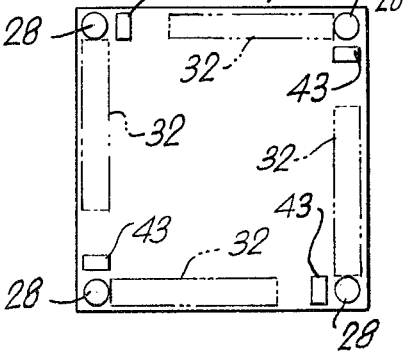
FIG. 4 is a plan view of the structure of FIG. 2, the loading doors being shown in phantom lines in their horizontal positions.

The working towers 28 are cylindrical, like the legs 14, and have a sufficient internal diameter to accommodate the pile sections 30. A vertical portion along one side of each working tower 28 forms a loading door 32 of a height at least equal to the length of one pile section 30. In its vertical or closed position, the door 32 is secured to the remainder of the tower 28 by a series of latches 33. The door 32 is pivotally connected to the rest of the working towers 28 at its bottom end so that it can be lowered into a horizontal position extending along one side of the working platform 28 (as best shown in phantom lines in FIGS. 4 and 5). A door winch 34 mounted on the opposite side of the tower 28 is connected to the door by a pair of cables 36 so that the door 32 can be raised and lowered.

Figure 6:
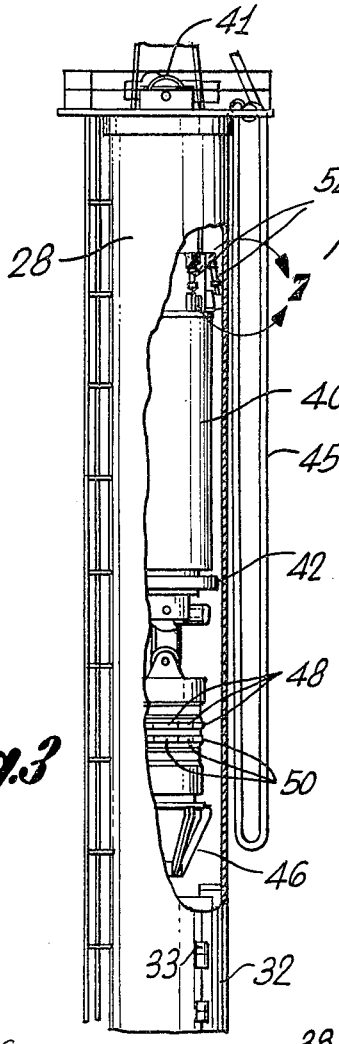
FIG. 6 is an enlarged, fragmentary view of the upper portion of one of the working towers, a portion of the tower being broken away to expose the alignment tool.
Figure 5:
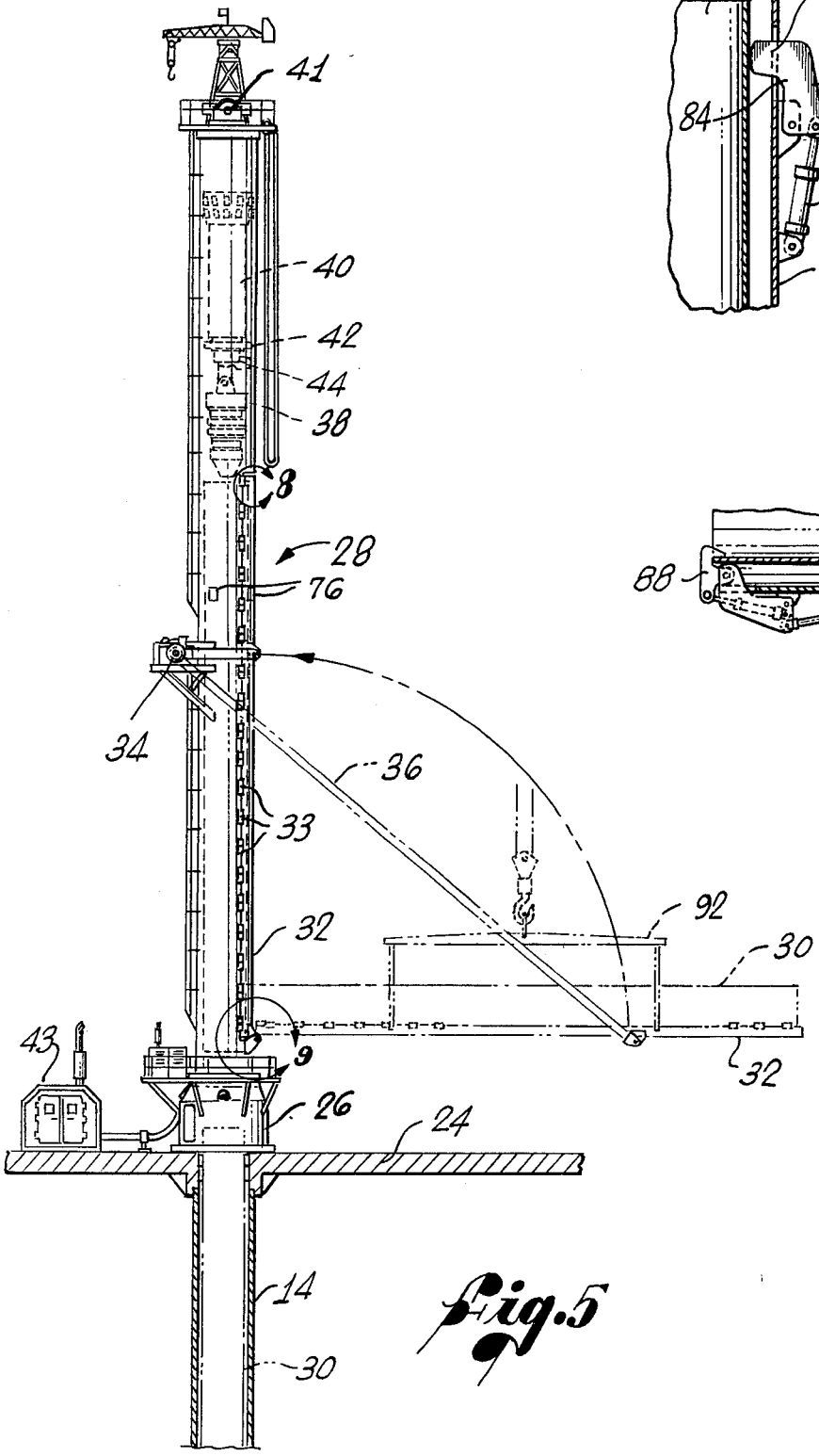
FIG. 5 is an enlarged, fragmentary view of a portion of the structure of FIG. 2 showing one of the working towers, the loading door being shown in phantom lines in its horizontal position.

Stored within the working tower 28 above the top of the door 32 is an alignment and lifting tool 38 and above the alignment tool is a large hydraulic jacking cylinder 40 in which a piston 42 is vertically reciprocable (the alignment tool and jacking cylinder being shown in FIG. 6 and in phantom lines in FIG. 5). The cylinder 40 is suspended from the top of the working tower 28 by a winch 41 by which it can be lowered and the alignment tool 38 is in turn supported by a winch 44 mounted on the head of the piston 42 at the bottom of the cylinder 40. Adjacent to each working tower 28 is a hydraulic power plant 43 that energizes its associated alignment tool 38 and jacking cylinder 40. Hydraulic power is supplied to the cylinder 40 through a line 45 including a loop, external to the tower 28, that is played out as the cylinder travels downwardly.

The alignment tool 38 is intended to be inserted axially in the pile section 30 and is, therefore, of a generally cylindrical configuration and of a smaller diameter than the inside of the pile 15. On its bottom end, it carries a downwardly pointed generally conical stabbing guide 46 that facilitates its inserted in the pile 15.

Arranged circumferentially about the outside of the alignment tool 38 are two sets of shims 48 and 50 spaced axially from each other. The shims 48 and 50 are operated hydraulically and can be expanded radially to engage the inside surface of the pile 15.

Figure 7:
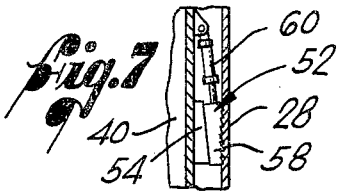
FIG. 7 is an enlarged, cross-sectional view of one of the slip mechanisms of the jacking cylinder.

A group of slip mechanisms 52 (shown in detail in FIG. 7) are arranged circumferentially about the jacking cylinder 40. Each slip mechanism 52 consists of a ramp 54 that slopes inwardly toward the top of the cylinder 40 and a wedge 56 that slides on the ramp with its narrow end pointing downward. The outer surface of the wedge 56 that opposes the inner surface of the working tower 28 carries a series of teeth 58 that extend across it horizontally, the teeth being oriented so that they resist upward motion of the jacking cylinder 40 when they engage the working tower 28.

Each wedge 56 is connected to a small doubleacting hydraulic slip cylinder 60 that causes it to move along the ramp 54, in and out of contact with the working tower 28, when actuated. When the slip cylinder 60 is extended, it pushes the wedge 56 downwardly along the ramp 54 until it engages the inside of the tower 28. When actuated in this manner, the slip mechanisms 52 can hold the jacking cylinder 40 stationary within the tower 28 despite large upwardly directed forces.

Figure 3:
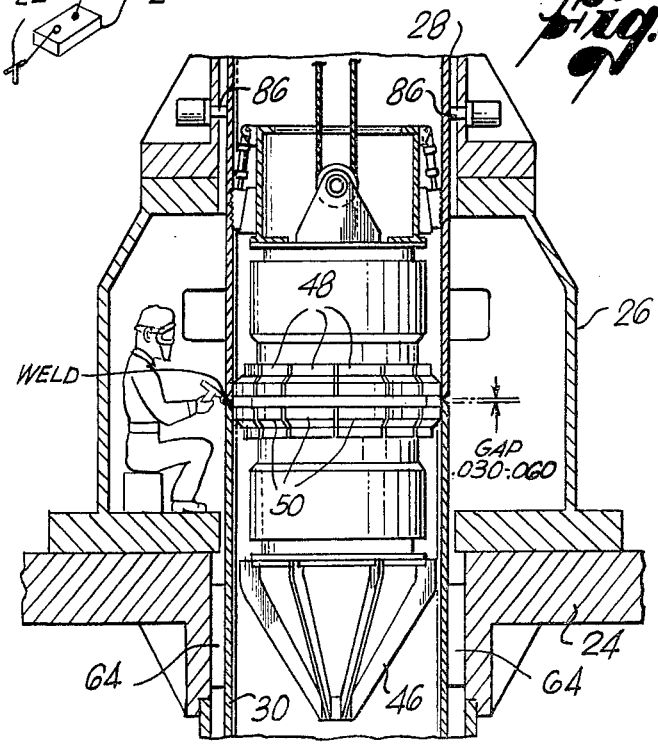
FIG. 3 is an enlarged, cross-sectional, side view of a portion of the structure of FIG. 2 that includes the welding habitat and the alignment tool (the latter not being sectioned)

The alignment tool 38 is provided at its top end with slip mechanism 62 of the same construction (see FIG. 3). These slip mechanisms 62 prevent upward movement of the tool 38 relative to the pile sections 30 or downward movement of the sections relative to the tool, thus permitting the tool to be used to lift the sections.

Packing devices 64 of a type known in the art are attached to the deck 24, surrounding each leg 14 near its top end (as shown in FIG. 3). When actuated, the packing devices 64 expand to tightly engage the pile 15 about its entire periphery for the purpose of holding the pile 15 against downward movement and one for holding the platform structure 10 against upward movement. If the pile 15 is not externally coated, slip mechanisms similar to those used on the jacking cylinder 40 and the alignment tool 38 can be used instead of the packing device 64.

Figure 8:
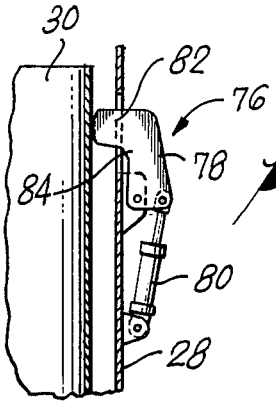
FIG. 8 is an enlarged, cross-sectional view of a fragmentary portion of the working tower showing one of the slip mechanisms for holding a pile section.

The lower portion of the working tower 28, that includes the door 32, is provided with guide mechanisms 76 (see FIG. 8), that center the pipe sections 30 radially. Each of these guide mechanisms 76 includes an L-shaped member 78 that is pivotably attached to the exterior surface of the working tower 28. A small hydraulic cylinder 80 mounted on the outside of the tower 28 below the L-shaped member 78 can be expanded to cause that member to pivot so that a foot portion 82 moves through a slot 84 in the tower to engage the pile section 30.

Also positioned on the inside of the working tower 28, just above the welding habitat 26 and below the loading door 32, are four circumferentially spaced, hydraulically-actuated positioning pistons 86 that can be extended inwardly against the side of a pile section 30 (see FIG. 3). The purpose of the centering piston 86 is fine adjustment of the attitude of the section 30.

Figure 9:
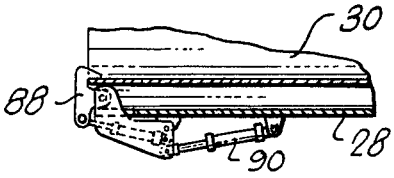
FIG. 9 is another enlarged, cross-sectional view of the lower end of the loading door showing the hook mechanism engaging the bottom end of a pile section.

At the very bottom of the loading door 32 is a hook 88 that can be pivoted, by a hydraulic cylinder 90 on the outside of the door, into a position in which it extends inwardly from the door and faced upwardly to receive the bottom edge of pile section 30 (see FIG. 9). The hook 88 supports the pile section 30 as it is first positioned within the working tower 28.

The method of erecting the structure 10 and driving the piles 15 will now be explained more fully. The structure 10, including the working platform 24 and the working towers 28, is assembled on land and floated out to the well site on a barge. It is then upended so that it stands vertically on the ocean floor, held in place only by the force of gravity.

Usually, pile sections 30 have already been inserted in each leg 14 to reach from the ocean floor into the welding habitats 26. The weight of those pile sections 30 may, however, be too great in relation to the capacity of the barge, in which case the sections that initially fill the legs 14 must be inserted through the loading doors 32 of the working towers 28 after the structure 10 is in position.

Assuming that the legs 14 have not been prefilled, the first section 30 of each pile 15 is hoisted by a sling 92 held by a barge-mounted crane (see phantom illustration of FIG. 5). The loading door 32 of one working tower 28 is lowered by the door winch 34 to a horizontal position and the section 30 is placed in the door (see phantom illustration of FIG. 5). Since the pile section 30 is handled in a horizontal position, the crane need not be capable of lifting it into a vertical position as would the case if conventional construction techniques were employed. Not only is it possible to use a smaller crane, but, since the center of gravity of the section 30 is much lower, the section is more stable with less chance of damage to its carefully prepared end surfaces that must be welded later.

With the hook 88 in its extended position to engage the bottom end of the pile section 30, the door 32 is raised by the winch 34 to its vertical position. The alignment tool 38 is lowered by its winch 44 and the shims 48 and 50 are expanded until they grasp the inside of the pile section 30. The section 30 is raised by the alignment tool 38 to remove the downward force on the hook 88 which can then be withdrawn. The hook 88 may include an over-center mechanism (not shown) that prevents it from being withdrawn while under load. The section 30 is lowered by the winch 44 until its top end is positioned within the welding habitat 26. It is then held by the packing devices 64 and the shims 48 and 50 are contracted so that the alignment tool 38 can be raised again.

A second section 30 of the pile 15 is loaded into the working tower 28 and suspended by the alignment tool 38. It is necessary to accurately position and align the second section 30 so that it can be welded to the first.

When the second section 30 is still held by the hook 88 and centered by the guides 76, it is about one to two feet above the first section. The alignment tool 38 is lowered until the lower set of shims 50 is disposed beneath the bottom end of the second section 30 and the upper shims 48 is expanded to firmly engage that section. The second section 30 is then gripped by the slip mechanisms 62 of the alignment tool 38 and raised by the winch 44. This upward motion removes the load from the hook 88, which can then be moved to an inoperative position. Simultaneously, the hook 88 is withdrawn and the second section 30 is slowly lowered by the alignment tool 38 while a welder in the habitat 26 observes the spacing. At the proper moment, the alignment tool 38 is stopped and the lower set of shims 50, which are now located within the first section 30, are partially expanded but are stopped about 32 thousandths of an inch short of firm engagement.

With the sections 30 thus held in a concentric relationship, the centering pistons 86 are employed to finely adjust the longitudinal axis of the second section 30 until the gap, which should be 30 to 60 thousandths of an inch, is uniform about the entire circumference. In view of the high loads the pile 15 will be subjected to, the weld must meet exacting standards which require that the sections 30 be positioned with great precision. (The need to prevent damage to the ends during handling will be appreciated.)

Once proper positioning has been attained, the lower shims 50 are expanded to fully engage the lower section 30. In addition to locking the sections 30 in a properly aligned relationship, the shims 48 and 50 remove any out of roundness from the sections, thereby achieving precise alignment throughout the entire circumference. The welding habitat 26 insulates the welding operation from wind and water spray, as shown in FIG. 3, making it possible to weld under adverse weather conditions.

After the welding is completed, the two sections 30 are released from the packing devices 64 and floated downwardly, as is known in the art, until only the top of the uppermost section projects into the welding habitat 26. Another section 30 is then loaded into the working tower 28 and welded in place in the same manner. Each successive section 30 is added in this way until the bottom of the pile 15 rests on the ocean floor. It is then time to begin driving the pile 15.

Figure 10:
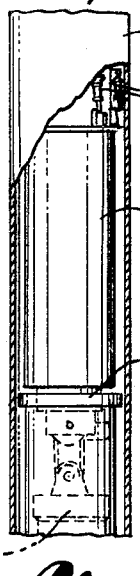
FIG. 10 is an enlarged, fragmentary view of a portion of one of the working towers, a portion of the tower being broken away to expose the jacking cylinder in engagement with a pile section, the alignment tool being shown in phantom lines.

The jacking cylinder 40 is lowered by its winch 41 until the head of the retracted piston 42 rests on the top end of the uppermost section 30, the alignment tool 38 being disposed within the section with its shims 48 and 50 contracted so that it does not engage the section (see FIG. 10). After the jacking cylinder slip mechanisms 52 have been actuated to engage the inside surface of the tower 28, the piston 42 is caused to move downwardly. Since the slip mechanisms 52 prevent the cylinder 40 from moving upwardly within the tower 28, the pile 15 is forced to move downwardly, penetrating the ocean floor.

After the cylinder 40 is fully extended and the piston 42 has reached the limit of its downward travel, it is contracted by retracting the piston while maintaining the piston head in contact with the top of the section 30. The jacking cylinder slip mechanisms 52 are reactivated and the cylinder 40 is extended again. This process is repeated until the top of the section 30 is located within the welding habitat 26. Another section 30 is then loaded into the working tower 28 and welded to the preceding section in the manner explained above.

The basic sequence of steps to be carried out according to the invention is illustrated diagrammatically, in simplified form, in FIGS. 11(*a*)–(*g*). As shown in FIG. 11*a*, a first pile section 30' is positioned vertically on the ocean floor 94 and a second section 30'' is positioned directly above it. (It is assumed here, for the sake of simplicity, that only one section is required to reach from the ocean floor 94 to the deck 24.) The second section 30'' is then lowered, aligned and welded to the top of the first and the retracted piston 42 of the jacking cylinder 40 is positioned in contact with the top of the second section. As the cylinder 40 is expanded, it jacks the pile 15 into the ocean floor 94 (FIG. 11*c*). The cylinder 40 is then contracted as it is lowered (FIG. 11*d*). Expansion of the cylinder 40 then jacks the pile 15 further into the ocean floor (FIG. 11*e*).

After the first pile section 30' has been completely driven into the ocean floor 96 in a stepwise manner by the expansion and contraction of the cylinder 40 (FIG. 11*f*), a third section 30''' can be loaded into the working tower 28 (FIG. 11*g*). The entire sequence of steps is then repeated and as many sections 30 as are required can be added in this way.

When driving the four piles 15 of the structure 10, diagonally opposite piles are driven simultaneously. In this way, the reaction forces acting on the structure 10 are always balanced and the structure remains stable. As the driving of the first sections 30 begins, the reaction force is opposed only by the weight of the structure 10. The adhesion forces on the piles 15 will increase, however, as the amount of penetration increases. It is, therefore, desirable to alternately drive the two pairs of diagonally opposite piles 15. The piles 15 that are not being driven oppose the reaction forces of the piles that are being driven. As the penetration increases and the reaction forces increase, the bearing capacity of the piles 15 also increases, so that it is always possible to drive deeper.

The greatest resistance to jacking the piles 15 comes from the adhesion forces of the soil on the external pile surfaces. To minimize these forces to the greatest extent possible, the technique of electro-osmosis may be employed. An electrically insulating coating is applied to the pile 15, preferably on the outside. A cathode is disposed on the tip 98 at the bottom of each pile 15 and an anode is located in the soil adjacent the pile to establish an electrical circuit through the soil. Water, attracted by the cathode and the presence of this water, allows the pile 15 to be driven with reduced force.

The above electro-osmosis arrangement (not shown in the drawings) is explained in greater detail in U.S. Pat. Nos. 4,046,647; 4,119,511 and 4,124,483, which are incorporated by reference herein, as is allowed application Ser. No. 936,981 of Lowell B. Christenson.

It will be noted that the force required to drive each pile 15 can be readily graphed, with precision, against the penetration of the pile 15. This information gives an accurate indication of the bearing capacity of the pile 15, which can be computed continuously as the pile is driven. One important advantage of these calculations is that they permit an on-site determination of the depth to which each individual pile 15 must be driven to obtain the bearing capacity required. The waste inherent in driving piles to predetermined depths, assumed to be necessary on the basis of test bores, is eliminated.

Piles driven according to the present invention can have substantially greater bearing capacity than piles driven to the same depth using hammers because the soil is not disturbed by radial movement and vibrations of the piles. The adhesion of the soil to the pile remains at a maximum. The piles can be lighter because the maximum instantaneous load is much lower than that reached when a hammer is used. In the past, piles have often been heavier than otherwise required simply to withstand the impact of the hammer. Although the piles have sufficient flexibility for guyed tower construction, they can easily withstand the jacking forces applied to them, especially when adhesion is reduced by electro-osmosis.

An important advantage of the present invention is that the driving equipment is much smaller and simpler and requires less energy input. Since the equipment for driving the pile is lighter and the pile sections need not be raised nearly as high, much smaller cranes can be used. Difficult alignment problems are avoided because successive pile sections being welded together are supported by the same structure.

While particular forms of the invention have been illustrated and described, it will also be apparent that various modifications can be made without departing from the spirit and scope of the invention.

I claim:

1. A method for driving a member into the ocean floor comprising the steps of:

positioning a tower on the ocean floor at a location where said member is to be driven;

positioning at least a first section of said member at said location contiguously with said tower;

positioning a second section of said member above said first section;

securing said second section to said first section;

positioning a jacking cylinder with a piston reciprocable therein above said second section and connecting said cylinder to said tower to prevent upward movement thereof;

jacking said first and second sections downwardly by causing said piston to move downwardly within said cylinder, pushing said sections before it;

retracting said piston within said cylinder and lowering said cylinder; and again causing said piston to move downwardly within said cylinder, thereby further jacking said first and second sections downwardly.

2. The method of claim 1 further comprising the additional steps of creating an electrical potential between said member and the surrounding soil to cause water to collect adjacent to the exterior surface of said member, thereby reducing the adhesion forces between said member and the surrounding soil.

3. The method of claim 1 wherein the step of securing said second section to said first section is performed by welding.

4. The method of claim 1 wherein said tower includes a movable portion and the step of positioning said second section is performed by:

pivotably lowering said movable portion into a substantially horizontal position;

placing said second section on said movable portion;

securing said second section to said movable portion; and pivotably raising said movable portion and said second section into approximate alignment with said first section.

5. A method for driving a vertical member into the ocean floor comprising the steps of:

positioning a tower on the ocean floor at a location where said member is to be driven;

positioning at least a first section of said member at said location contiguously with said tower;

positioning a second section of said member above said first section and in approximate alignment therewith;

lowering an alignment tool through said second section and positioning it adjacent the lower end of said second section and the upper end of said first section;

expanding an upper portion of said alignment tool to engage said second section;

expanding a lower portion of said alignment tool to engage said second section;

welding said second section to said first section;

contracting said upper and lower portions of said alignment tool to disengage said first and second sections;

positioning a jacking cylinder with a piston reciprocable therein above said second section and connecting said cylinder to said tower to prevent upward movement thereof; and causing said piston to move downwardly within said cylinder, thereby jacking said first and second sections downwardly.

6. The method of claim 5 further comprising the following steps:

retracting said piston and lowering said cylinder; and again causing said piston to move downwardly within said cylinder, thereby jacking said first and second sections downwardly.

7. The method of claim 5 further comprising the step of creating an electrical potential between said member and the surrounding soil to cause water to collect adjacent to the exterior surface of said member, thereby reducing the adhesion forces between said member and the surrounding soil.

8. The method of claim 5 wherein said tower includes a movable portion and the step of positioning said second section is performed by:

pivotably lowering said movable portion into a substantially horizontal position;

placing said member on said movable portion;

securing said member to said movable portion; and pivotably raising said movable portion and said member.

9. A method for driving a member into the ocean floor comprising the steps of:

positioning a tower on the ocean floor at a location where said member is to be driven;

positioning at least a first section of said member at said location contiguously with said tower;

pivotably lowering a portion of said tower into a substantially horizontal position;

positioning a second section of said member on said portion of said tower;

securing said second section to said portion of said tower;

pivotably raising said portion of said tower until said second section is at least approximately aligned with said first section;

releasing said second section from said portion of said tower; and applying a force to said second section to drive said member into the ocean floor.

10. The method of claim 9 wherein the last mentioned step thereof is performed by:

positioning a jacking cylinder with a piston reciprocable therein above said second section and connecting said cylinder to said tower to prevent upward movement thereof; and causing said piston to move downwardly within said cylinder, thereby jacking said first and second sections downwardly.

11. A method for driving a member into the ocean floor comprising the steps of:

positioning a tower on the ocean floor at a location where said member is to be driven;

positioning at least a first section of said member at said location contiguously with said tower;

pivotably lowering a portion of said tower into a substantially horizontal position;

positioning a second section of said member on said portion of said tower;

securing said second section to said portion of said tower;

pivotably raising said portion of said tower until said second section is approximately aligned with said first section;

lowering an alignment tool supported by said tower through said second section and positioning said alignment tool adjacent the lower end of said second section and said upper end of said first section;

expanding said alignment tool to firmly engage one of said sections and to loosely engage the other of said sections;

moving said second section to complete its alignment with said first section;

further expanding said alignment tool to firmly engage said other section;

welding said second section to said first section;

contracting said upper and lower portions of said alignment tool to disengage said first and second sections; and applying a force to said second section to drive said member into the ocean floor.

12. The method of claim 11 wherein the last mentioned step thereof is performed by:

positioning a jacking cylinder with a piston reciprocable therein above said second section;

connecting said cylinder to said tower to prevent upward movement thereof; and causing said piston to move downwardly within said cylinder, thereby jacking said first and second sections downwardly.

13. The method of claim 12 further comprising the following steps:

retracting said piston and lowering said cylinder;

reconnecting said cylinder to said tower to prevent upward movement thereof; and again causing said piston to move downwardly within said cylinder, thereby jacking said first and second sections downwardly.

14. The method of claim 12 further comprising the steps of creating an electrical potential between said member and the surrounding soil to cause water to collect adjacent to the exterior surface of said member, thereby reducing the adhesion forces between said member and the surrounding soil.

15. The method of claim 14 further comprising the additional step of creating an electrical potential between said member and the surrounding soil to cause water to collect adjacent to the exterior surface of said member, thereby reducing the adhesion forces between said member and the surrounding soil.

16. A method of driving pilings for an oil or gas well platform comprising the following steps:

positioning a platform structure so that it has a platform extending horizontally above the water surface and four legs at the corners of said platform extending substantially vertically from said platform to the ocean floor, each of said legs forming a jacket in which one of said piles are to be located, said platform including four working towers, each of said working towers forming an extension of one of said legs projecting above said platform;

positioning at least one first pile section contiguously with each of said legs;

pivotably lowering loading doors of two diagonally opposite upper towers into horizontal positions;

positioning at least one second pile section on each of said lowered doors;

securing said second sections to said doors;

pivotably raising said doors to position said second sections above corresponding ones of said first sections;

releasing said second sections from said doors;

welding said second sections to said first sections;

lowering jacking cylinders having reciprocable pistons therein into engagement with said second sections and connecting said cylinders to corresponding ones of said working towers to prevent upward movement thereof; and causing said pistons to move downwardly within said cylinders, thereby simultaneously jacking said diagonally opposite piles downwardly.

17. The method of claim 16 further comprising:

retracting said pistons within said cylinders and lowering said cylinders; and again causing said pistons to move downwardly within said cylinders, thereby simultaneously jacking said first and second sections downwardly.

18. The method of claim 16 further comprising the step of creating an electric potential between said piles and the surrounding soil to cause water to collect adjacent to the exterior surface of said piles, thereby reducing the adhesion forces between said piles and the surrounding soil.

19. The method of claim 16 comprising the steps of:

pivotably lowering loading doors of the remaining two of said upper towers;

securing at least one second pile section on each of said last mentioned loading doors;

pivotably raising said last mentioned doors to position said last mentioned second sections above corresponding ones of said first sections;

releasing said last mentioned second sections from said doors;

welding said last mentioned second sections to said corresponding ones of said first sections;

lowering additional jacking cylinders having reciprocable pistons therein into engagement with said second sections and connecting said cylinders to corresponding ones of said working towers to prevent upward movement thereof; and causing said last mentioned pistons to move downwardly within said cylinders, thereby simultaneously jacking said last mentioned diagonally opposite piles downwardly.

20. A platform structure and associated apparatus for constructing an off-shore oil or gas well comprising:

a square deck disposed horizontally above the water surface;

four vertical towers, each of which is disposed at a corner of said deck, each of said towers including a leg portion that extends downwardly from said platform to the ocean floor and provides a jacket in which a pile to be driven into the ocean floor can be disposed and a working tower that extends upwardly from said platform in alignment with said leg portion;

a jacking cylinder disposed within each of said working towers;

a piston vertically reciprocable within each of said working towers;

hydraulic means for moving said pistons within each of said cylinders; and cylinder slip means for connecting each of said cylinders to a corresponding one of said working towers to prevent upward movement of said cylinders within said working towers.

21. The apparatus of claim 20 further comprising alignment within each of said working towers that is insertable within one of said piles for engaging and aligning successive sections of said pile.

22. The apparatus of claim 21 further comprising:

additional slip means mounted on each of said alignment means for preventing relative movement between said alignment means and one of said piles in which it is inserted; and means connected to said alignment means for lifting sections of said pile by said alignment means.

23. The apparatus of claim 21 wherein said alignment means includes at least two sets of radially expandable shims for engaging said piles.

24. The apparatus of claim 21 further comprising radially movable positioning means within each of said upper towers for engaging said pile sections externally and positioning said pile sections.

25. The apparatus of claim 20 wherein each of said working towers includes:

a loading door normally extending vertically and pivotable into a horizontal position;

means for securing a section of one of said piles to said loading door; and means for raising said door to a vertical position with said section secured thereto.

26. A method for anchoring an off-shore structure of the guyed tower type comprising the steps of:

positioning said structure on the ocean floor in a water depth of about 1000 feet or more;

positioning at least a first pile section contiguously with said structure;

positioning a jacking cylinder with a piston reciprocable therein above said first pile section;

causing said piston to move downwardly within said cylinder, thereby jacking said first section downwardly;

positioning a second pile section above said first pile section;

positioning said cylinder above said second section; and again causing said piston to move downwardly within said cylinder, thereby jacking said first and second pile sections downwardly.

27. The method of claim 26 comprising the further step of securing said cylinder to said structure before causing said piston to move downwardly, thereby resisting upward movement of said piston.

28. The method of claim 26 wherein said structure includes a leg that serves as a jacket for said pile sections, said sections being placed within said leg when positioned contiguously with said structure.

29. A method for anchoring an off-shore structure comprising the steps of:

positioning a plurality of pile sections to be driven contiguously with said structure;

at least partially driving a first one of said sections into the ocean floor;

connecting said structure to said first pile section to prevent upward movement of said structure;

positioning a second pile section continguously with said structure;

positioning a jacking cylinder with a piston reciprocable therein above said second pile section; and causing said piston to move downwardly within said cylinder, thereby jacking said second pile section downwardly.

* * * * *

UNITED STATES PATENT AND TRADEMARK OFFICE

CERTIFICATE OF CORRECTION

PATENT NO. : 4,257,720

DATED : March 24, 1981

INVENTOR(S) : John T. Ostgaard

It is certified that error appears in the above-identified patent and that said Letters Patent are hereby corrected as shown below:

IN THE ABSTRACT, line 10, "prececing" should be --preceding--;

Column 2, line 47 "unrealability" should be --unreliability --;
Column 5, line 63 "inserted" should be --insertion--;
Column 6, line 60 "faced" should be --faces--;
Column 9, line 29 "4,046,047" should be --4,046,057--;

IN THE CLAIMS:
Column 13, line 19 "surface" should be --surfaces--;
Column 13, line 66 after "alignment add --means--;
Column 14, line 59 "continguously" should be --contiguously--.

Signed and Sealed this

*Fourteenth* Day of *July 1981*

[SEAL]

*Attest:*

GERALD J. MOSSINGHOFF

*Attesting Officer*

*Commissioner of Patents and Trademarks*